US005595366A

United States Patent [19]

Cusimano et al.

[11] Patent Number: 5,595,366

[45] Date of Patent: Jan. 21, 1997

[54] SEISMIC FOUNDATION PIER

[75] Inventors: Matt Cusimano, Aptos; Douglas W. Ladd, Clovis, both of Calif.

[73] Assignee: Central Piers, Inc., Fresno, Calif.

[21] Appl. No.: 384,666

[22] Filed: Feb. 6, 1995

[51] Int. Cl.[6] ..... E02D 27/48

[52] U.S. Cl. ..... 248/354.3; 52/126.6; 248/357

[58] Field of Search ..... 248/352, 354.3, 248/357, 188.4; 52/126.6, 126.7; 254/98, 100

[56] References Cited

U.S. PATENT DOCUMENTS

| | | | |
|---|---|---|---|
| 4,404,780 | 9/1983 | Josephson | 248/357 X |
| 4,546,581 | 10/1985 | Gustafson | 52/126.6 X |
| 4,870,789 | 10/1989 | Clark et al. | 248/354.3 X |
| 4,895,335 | 1/1990 | Oliver | 248/354.3 |
| 4,976,077 | 12/1990 | Tucker | 52/126.6 |
| 5,363,610 | 11/1994 | Thomas et al. | 52/126.6 X |
| 5,509,237 | 4/1996 | Coulter | 248/357 X |

*Primary Examiner*—Derek J. Berger
*Attorney, Agent, or Firm*—Robert Charles Hill

[57] ABSTRACT

A foundation pier for supporting a movable dwelling, such as a mobile home or commercial coach is provided. The pier provides enhanced seismic and wind force absorption properties over prior art piers. The invented pier includes a base plate having a threaded shaft affixed thereto. A plurality of webs are spatially positioned about the shaft at predetermined intervals. A support member has a first end threadably coupled to the shaft for adjusting the height of the pier. Couple members detachably couple to second end of the support member for attaching the pier to a support beam of the movable dwelling to prevent movement between the pier and the dwelling. A clamp member is affixed to the plurality of webs. The clamp member couples to the support member for preventing movement of the support member relative to the shaft and the clamp member. Environmental forces applied to the support member are transmitted from the clamp member and distributed through the plurality of webs to prevent the pier from collapsing.

11 Claims, 4 Drawing Sheets

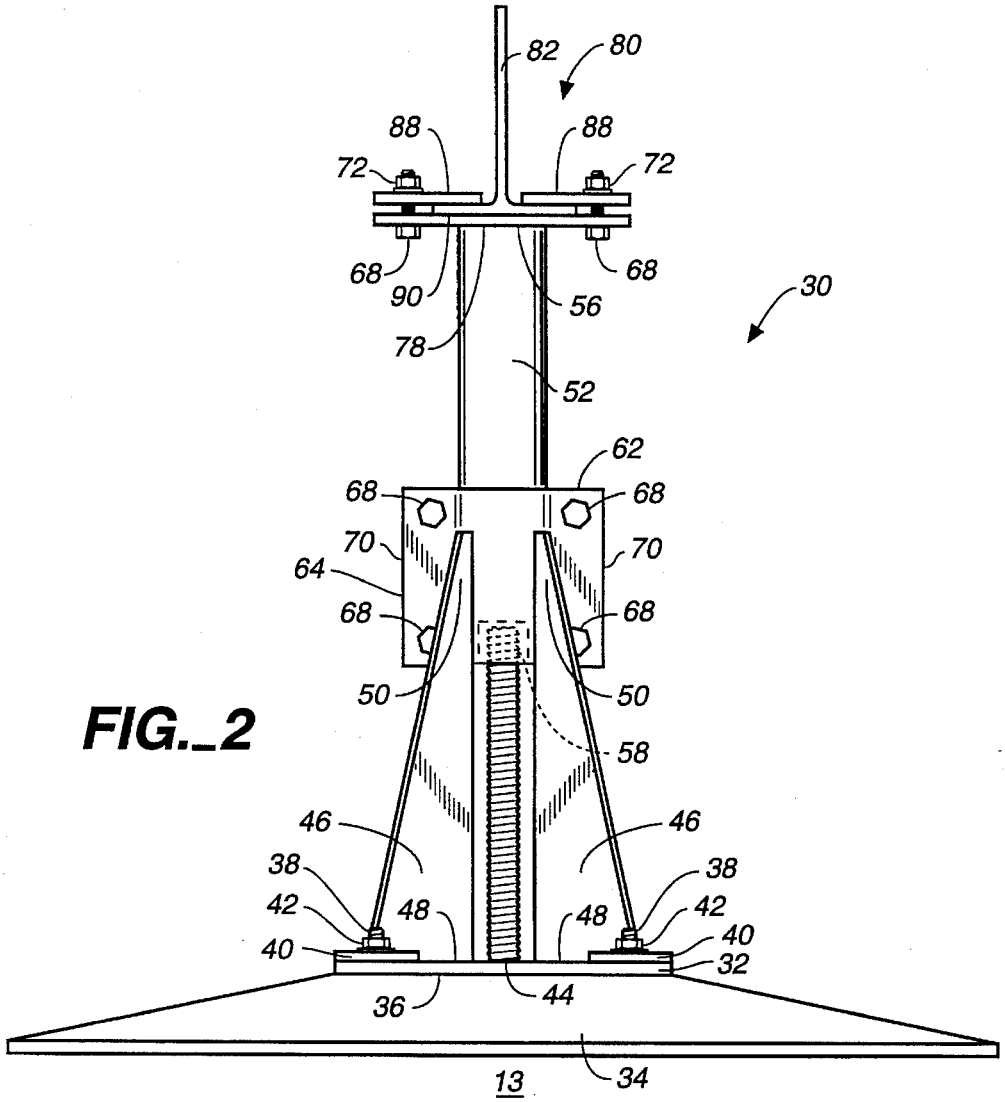
FIG._2
FIG._4a
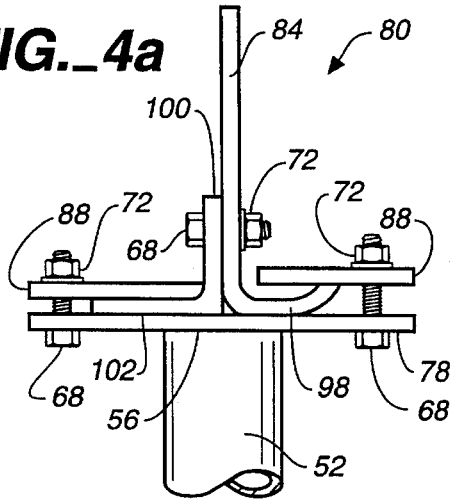
FIG._4b
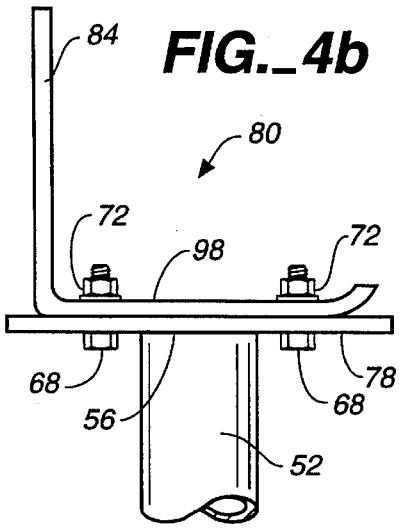

SEISMIC FOUNDATION PIER

BACKGROUND OF THE INVENTION

1. Field of the Invention

This invention relates generally to foundations for movable dwellings, such as mobile homes and commercial coaches, and more particularly, to an improved pier for supporting a movable dwelling that substantially resists environmental forces, such as seismic and wind forces.

2. Description of Related Art

Foundation piers are well known in the art. Piers are typically used to support beams, girders, floor joists, and the like. Piers are often used in the foundation systems of movable dwellings, such as mobile homes and commercial coaches for example. Since these dwellings are movable, foundation systems incorporating piers are a preferable system for supporting the dwelling, as the foundation system can be disassembled if it is desired to move the dwelling.

Movable dwellings typically comprise a prefabricated modular unit, with the length thereof substantially greater than the width, to provide ease of transporting the unit for example. The unit is typically fabricated with a plurality of spatially positioned, elongated support girders or beams that extend along the longitudinal axis of the unit. The support beams often have an "I" configuration. A plurality of spatially positioned floor joists are supported by the beams and extend across the width of the unit. Some movable dwellings may incorporate a perimeter chassis that has a beam having a "C" configuration.

Piers are used to support the beams and may be positioned beneath a beam, at an intersection of the beam and a joist. Units configured with C-beams may have piers spatially positioned along the beam at predetermined intervals to support the unit. The distance between the piers is governed by such factors as the dimensions of the unit and applicable building codes at the installation location of the unit, for example.

FIG. 1 of the drawings shows a schematic representation of a prior art pier 10. The prior art pier 10 shown comprises a base plate 12 for supporting the pier on the ground 13 and pair of opposing supports 14 affixed to the base 12. The supports 14 may comprise opposing portions of angle iron, for example, that extend perpendicular to each other. Extensions 16 are coupled to the supports 14 using bolt-nut combinations 18. A plurality of holes 20 may be disposed through the longitudinal axis of both the supports 14 and extensions 16.

The piers 10 are installed by adjusting the extensions 16 until a top portion 22 of the extensions 16 abuts a desired beam (not shown). The bolts 18 are then disposed through the holes 20, then nuts (not shown) then threaded onto the bolts 18 to secure the extensions 16 to the supports 14. The plurality holes 20 enable the extensions 16 to be secured to the supports 14 at different locations for adjusting the height of the pier 10.

The piers 10 may include means for coupling the extensions 16 to the beam. Such coupling means (not shown) may comprise a platform affixed to the top edge 22 of the extensions 16. The platform may have an upwardly extending threaded shaft at each corner thereof. A plate is held is a desired horizontal position by the threaded shafts using well known methods. The plate is adjusted upwardly until it abuts the desired beam. A pair of brackets that are coupled to the shafts, are then placed over the bottom portion of the desired beam. The brackets are then tightened onto the bottom portion of the beam. A disadvantage of the discussed coupling means, is that is was somewhat unstable due to the length of the shafts. Lateral forces applied to either the beam or the pier 10 could cause the coupling means to fail.

A further disadvantage of the discussed prior art pier, is that while the extensions 16 reside tightly against the supports 14, a substantial amount of force on the extensions 16 is transferred to the bolts 18, instead of the supports 14. Seismic activity and wind forces can substantially increase the amount of force applied to the pier 10, causing the bolts 18 to fail. Particularly, force applied to the bolts 18 from the extensions 16 may shear the bolts 18, causing the extensions 16 to suddenly drop. Thus, the pier 10 no longer supports the beam, which could result in damage to the unit and to the pier 10.

There therefore exists a need for a pier that resists environmental forces applied thereto due to seismic activity, wind, and the like, to prevent the pier from failing.

OBJECTS OF THE INVENTION

It is therefore an object of the present invention to provide an improved pier for supporting a movable dwelling;

It is another object of the present invention to provide an improved pier for supporting a movable dwelling that does not fail from increased force applied thereto due to environmental forces such as seismic activity or wind;

It is still another object of the present invention to provide an improved pier for supporting a movable dwelling that may be installed in an existing foundation system;

It is another object of the present invention to provide a pier that directly couples to a support beam of a movable dwelling; and It is a further object of the present invention to provide a pier that may be installed by hand.

SUMMARY OF THE INVENTION

These and other objects and advantages of the present invention are achieved by providing an improved foundation pier for supporting a movable dwelling, such as a mobile home or commercial coach. The pier includes a base with a threaded shaft affixed thereto. The base includes means for inhibiting relative movement between the base and a ground surface.

A support member is threadably coupled to the shaft for adjusting the height of the invented pier. A second end of the support member includes couple means for attaching the pier to a support beam of the movable dwelling, to prevent movement between the support member and the beam. The couple means can be configured to couple to a beam having either an "I" or a "C" configuration.

A plurality of webs are affixed to the base. The webs are spatially positioned about the shaft and support member at predetermined intervals. The plurality of webs prevent the support member and shaft from failing when increased lateral or horizontal forces are applied thereto.

Clamp means are affixed to the plurality of webs at a distance above the base. The clamp means comprises first and second portions for receiving the support member therebetween. The clamp means couples to the support member for preventing movement of the support member relative to the shaft and the clamp means.

In the presence of increased environmental forces, due to seismic activity or wind for example, force applied to the support member from the support beam, is transmitted from the support member through the clamp means and distributed through the plurality of webs. Since there is substantially no inadvertent movement between the components of the invented pier when increased forces are applied thereto, the pier acts in a unitary fashion so that it does not collapse or become detached from either the ground or support beam, which could cause harm to the supported dwelling.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

FIG. 2 is a front elevational view of a preferred embodiment of a pier of the present invention;

Figure 5:
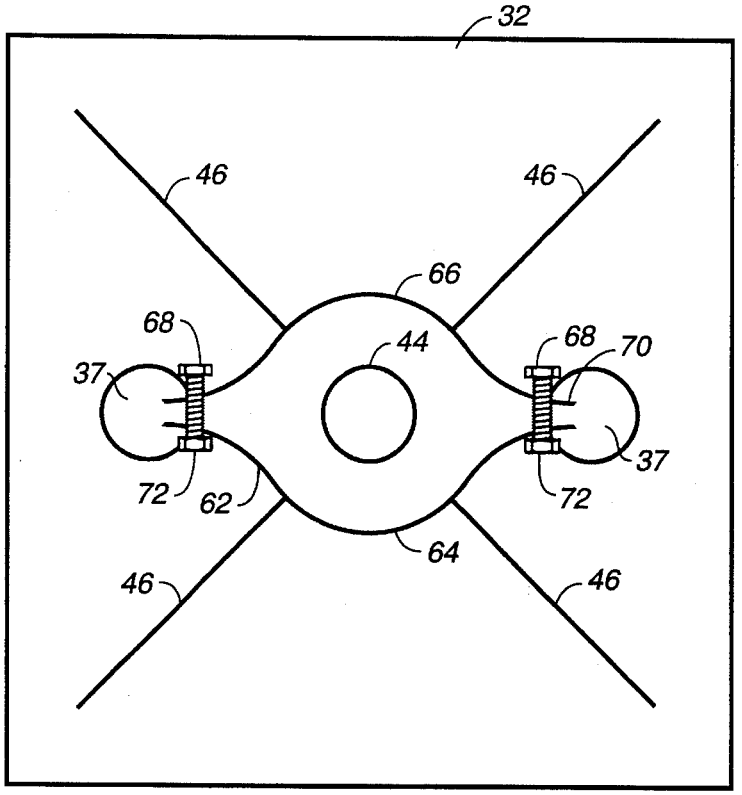
Figure 6:
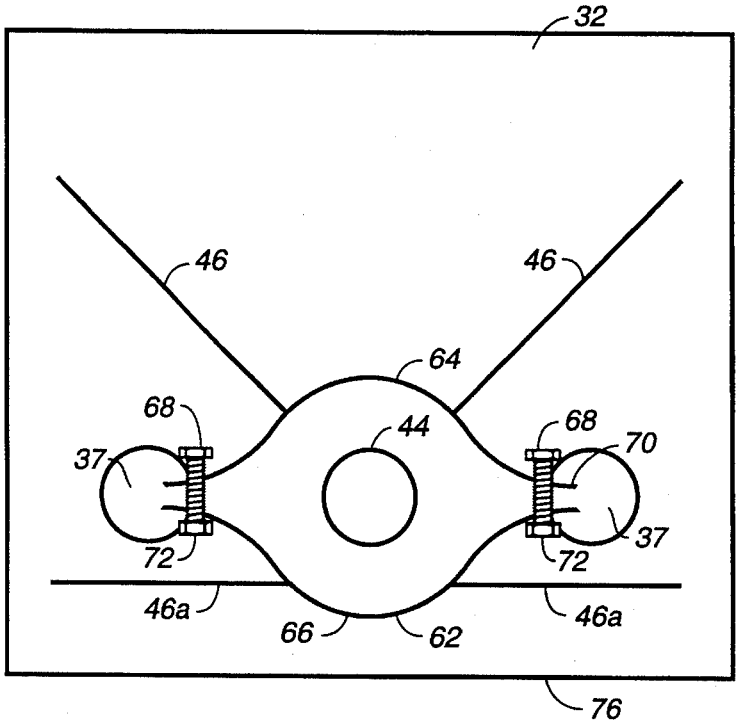

FIGS. *4a–4b* fragmentary views showing couple means of the present invention;

FIGS. *4c* is an exploded, fragmentary view showing couple means of the present invention;

FIG. 5 is a top plan, schematic view showing a portion of the present invention; and FIG. 6 is a top plan, schematic view showing a portion of the second embodiment of the present invention.

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein.

Referring now to FIG. 2 of the drawings, there is shown a preferred embodiment of a foundation pier 30 for supporting a movable dwelling (not shown), such as a mobile home, constructed according to the principles of the present invention. The invented pier 30 includes a rectangular base plate 32 that may be secured to a pad 34 to prevent relative slippage between the base plate 32 and the ground 13. The pad 34 may comprise a rectangular portion of pre-cast concrete, for example, that is substantially larger than the base 32. The pad 34 may be approximately 24 inches wide, 36.5 inches long, and 3.5 inches high. Alternatively, the pad 34 may comprise a suitable portion of plywood sheeting (not shown). A suitable portion of plywood sheeting could be substantially 30 inches wide and 32 inches long. Further, the pad 34 may be secured to the ground 13 using known means, such as disposing bolts (not shown) through the pad 34 and into the ground 13.

The pad 34 shown has a flat rectangular top portion 36 dimensioned to retain the base 32 thereon. Bolts 38 are disposed through apertures 37 (shown in FIG. 5 and FIG. 6) in the base 32 and reside in cavities formed in the top portion 36 of pad 34. A washer 40 is then placed over the bolts 38 and a nut 42 is threaded onto each bolt 38, to secure the base 32 to the pad 34. In the preferred embodiment, the base 32 comprises a suitable portion of steel alloy that is 5/16 inch thick and approximately 8 inches wide and 8 inches long.

A threaded shaft 44 is welded to the base 32 a centermost position thereof and extends perpendicular thereto. The shaft 44 may comprise a weldable cold-drawn, low carbon steel alloy. The shaft 44 may have a diameter ranging from ¾ inch to 1 inch, with the length thereof ranging from 10 to 18 inches, depending on the dimensioning of the pier 30.

A plurality of webs 46 are spatially positioned about the shaft 44 at desired distance therefrom and are affixed to the base 32 at predetermined intervals. Each web 46 has a first end 48 affixed to the base 32 and a second end 50. In the preferred embodiment, the webs 46 are affixed to the base 32 at substantially 90 degree intervals. The first end 48 of each web 46 is substantially wider than the second end 50 to provide a secure mounting location and to distribute force applied to the pier 30 through the webs 46. The webs 46 comprise 3/16 inch thick steel alloy plate and are dimensioned in length to extend slightly above the shaft 44. The width of the web's first end 48 may range from 3 inches to 4 inches, depending upon the length of the web 46, while the width of the second end 50 is approximately 1 inch.

An elongated, cylindrical support member 52 is threadably coupled to the shaft 44 for threading the support member 52 longitudinally along the shaft 44 to adjust the height of the pier 30. The support member 52 is dimensioned to couple to the shaft 44, while being interposed between the webs 46. The support member 52 includes a first end 54 (shown in FIG. 3) and a second end 56. The support member 52 comprises a hollow steel alloy pipe that is approximately 2 inches in diameter and 3/16 inch thick. The length of the support member 52 may range from 4 inches to 14 inches depending upon the desired height adjustment range of the pier 30.

An annular threaded insert 58 (best seen in FIG. 3) is press-fit into the first end 54 of the support member 52. The insert 58 includes an annular flange 60 affixed thereto. The flange 60 is dimensioned to abut the first end 54 of the support member 52, when the insert 58 is substantially residing in the support member 52. The insert 58 is threaded and dimensioned complementary to the desired shaft 44 for coupling the support member 52 to the shaft 44.

Referring now to FIGS. 2, 3, 5 and 6 of the drawings, clamp means 62 are shown affixed to the plurality of webs 46. In the preferred embodiment, the clamp means 62 comprises a first portion 64 and a second portion 66 for receiving the support member 52 therebetween. The clamp portions 64, 66 are affixed, by welding for example, to adjacent pairs of the plurality of webs 46. The first 64 and second 66 portions of the clamp means 62 are located adjacent to and oppose one another. Each of the portions 64, 66 are affixed to the web 46 adjacent to the second end 50 thereof. Bolts 68 are disposed through holes (not shown) located adjacent side edges 70 of the clamp portions 82, 84. Nuts 72 are threaded onto the bolts 68 to reduce the distance between the first and second portions 64, 66.

Figure 3:
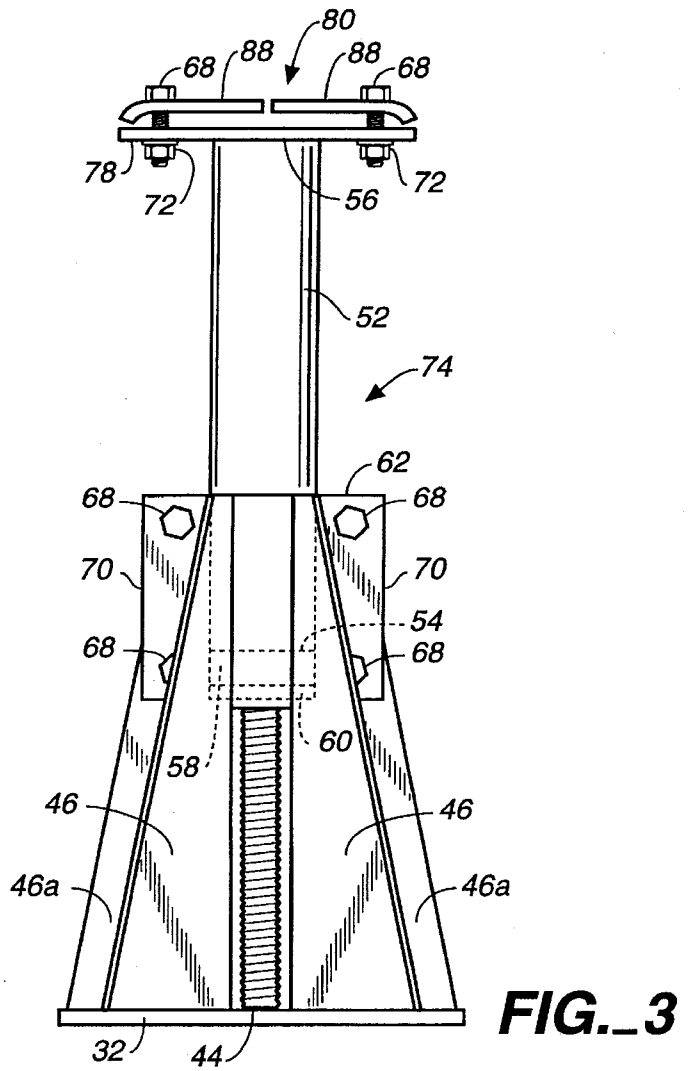
FIG. 3 shows a second embodiment of the invented pier.
Figure 1:
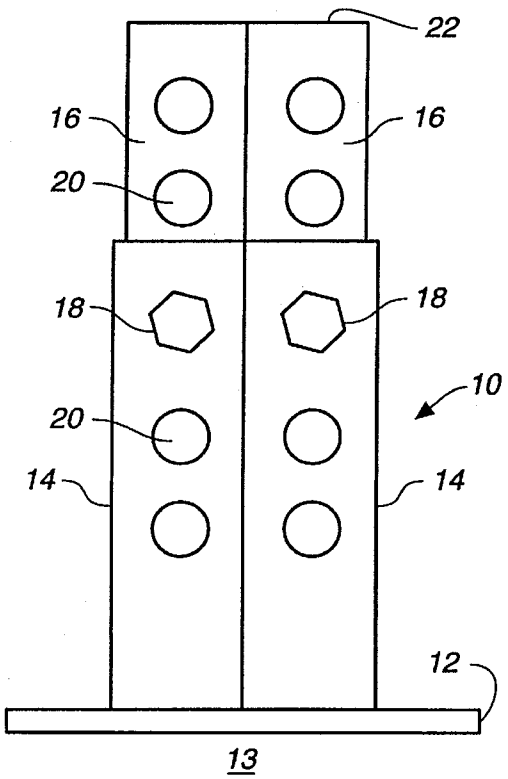
FIG. 1 (PRIOR ART)
FIG. 1 is a front elevational, schematic view of a prior art pier.
Figure 4C:
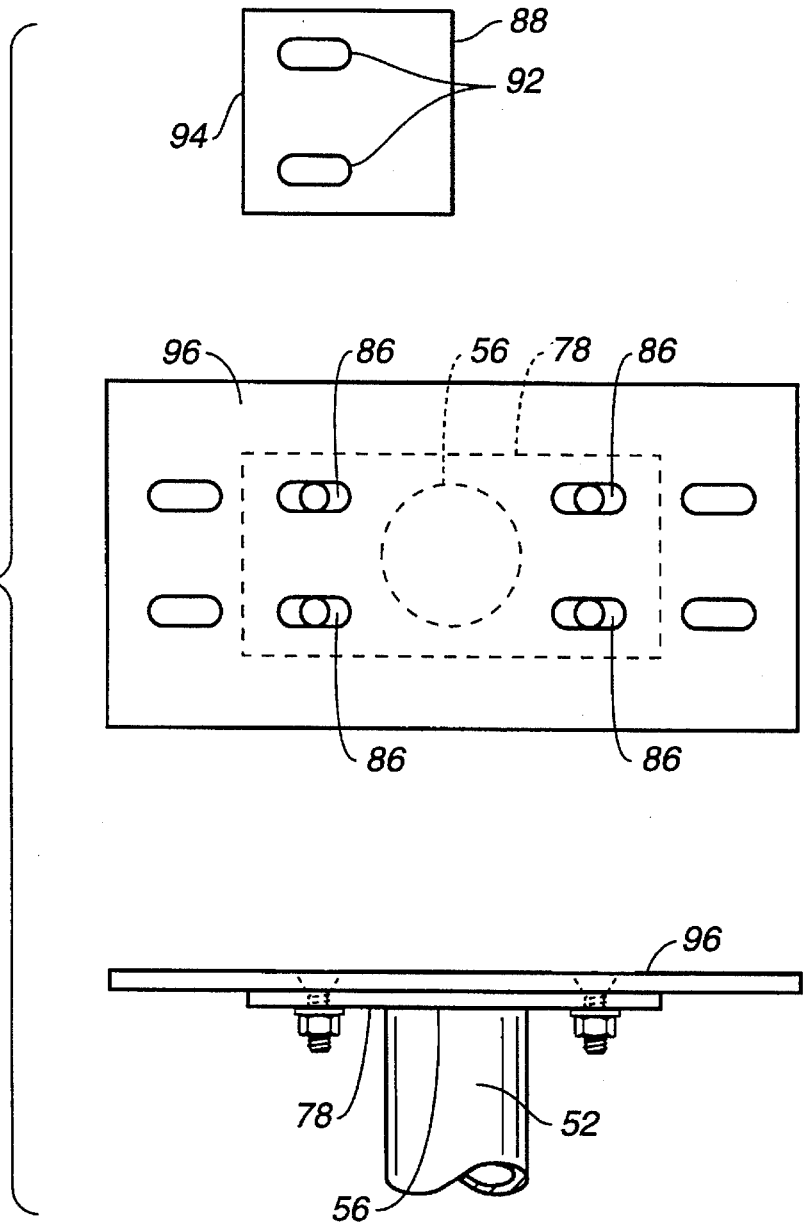

Referring now to FIG. 3 and FIG. 6 of the drawings, there is shown a second embodiment 74 of the pier of the present invention. The second pier 74 shown is configured for use with movable dwellings having perimeter chassis, such as a commercial coach, that have a C-beam (shown in FIG. *4a* and FIG. *4b*) that extends around the periphery of the dwelling. The shaft 44 is affixed to the base 32 adjacent to a back edge 76 thereof. A first pair of the webs 46*a* are affixed to the base 32 and the second portion 66 of the clamp means 62. The first pair of webs 46*a* extend substantially parallel to the back edge 76 of the base 32 and are in substantial alignment with one another. A second pair of the plurality of webs 46 are affixed to the base 32 and first portion 64 of the clamp means 62 as previously discussed. The second pair of webs 46 form an angle of approximately ninety degrees therebetween, while each web 46 of the second pair forms an angle of substantially forty five degrees with the adjacent web 46*a* of the first pair.

Referring now to FIGS. 2–4*c* of the drawings, the second end 56 of the support member 52 has a flat rectangular head plate 78 welded thereto. The head plate 78 includes couple means 80 detachably coupled thereto for attaching the desired pier 30, 74 to a support beam having either an "I" configuration 82 or a "C" configuration 84 of a movable dwelling (not shown). The head plate 78 has a plurality of elongated apertures 86 (shown in FIG. 4*c*) formed therethrough and aligned with the longitudinal axis thereof. The apertures 86 are formed adjacent to each corner of the head plate 78 and may be 7/16 inch wide and 1 inch long, for example. The head plate 78 comprises a portion of steel alloy that is ¼ inch thick and substantially 3 inches wide and 6 inches long, in the preferred embodiment.

The couple means 80 includes a pair of coupling plates 88 for retaining a bottom portion 90 of the I-beam between the coupling plates 88 and head plate 78. Each coupling plate 88 is dimensioned to have a width substantially equal to the width of the head plate 78 and a length substantially one half the length of the head plate 78. Each of the coupling plates 88 have a pair of apertures 92 formed adjacent to a side edge 94 thereof (shown in FIG. 4*c*). The apertures 92 are dimensioned and positioned complementary to the apertures 86 in the head plate 78. Therefore, when the plates 88 are positioned above the head plate 78, the apertures 92 of the coupling plates 88 are in alignment with the apertures 86 in the head plate 78.

The head plate 78 may have an oversized platform 96 affixed thereto. The oversize platform 96 would be used to couple the support member 52 to larger configurations of the I-beam 82 and C-beam 84.

Bolts 68 are adapted to be disposed through the apertures 86, 92 in the coupling plates 88 and head plate 78. Nuts 72 are threaded onto bolts 68 for attaching the coupling plates 88 to the head plate 78. The bolts 38, 68, washers 40, and nuts 42, 72, used in the present invention comprise a suitable hardened steel alloy to prevent them from failing due to increased environmental forces. The piers 30, 74 of the present invention may have a coating of a weather-resistant material applied thereto, to prevent harm from coming to the pier 30, 74 due to environmental elements such as rain, snow, and wind for example.

Referring now to FIG. 2 and FIG. 3, in use the support member 52 and webs 46, 46*a* can be dimensioned so that the invented pier 30, 74, has height adjustment ranges of 6–10 inches, 10–18 inches, and 18–32 inches. A pier 30, 74 having the desired height adjustment range is selected. The base 32 is placed in a desired location, such as on a suitable pad 34, and secured thereto to prevent the base 32 from moving relative to the ground 13. The pad 34 may be secured to the ground 13 to further prevent movement between the pier 30, 74 and the ground 13. The support member 52 is then threaded upwardly to increase the height of the pier 30, 74. The support member 52 is threaded upwardly, until the head plate 78 abuts the desired support beam 82, 84. Once the head plate 78 abuts the support beam 82, 84, the couple means 80 are used to attach the support member 52 to the beam 82, 84, to prevent movement between the support member 52 and the beam 82, 84.

If the support member 52 is going to couple to an I-beam 82, the coupling plates 88 are placed over the bottom portion 90 of the I-beam 82, with the apertures 92 thereof in alignment with the apertures 86 in the head plate 78. The bolts 68 are then disposed through the apertures 86, 92. The nuts 72 are threaded onto the bolts 68 for tightening the coupling plates 88 onto the bottom portion 90 of the I-beam 82 for coupling the support member 52 to the I-beam 82, to prevent movement therebetween.

Referring now to FIG. 4*a* and FIG. 4*b* of the drawings, if the support member 52 is going to couple to a C-beam 84, a pier 74 having the desired web configuration and height adjustment range is selected. The support member 52 is adjusted upwardly as previously discussed. When the head plate 78 abuts the C-beam 84 an appropriate couple means 80 is selected depending upon the dimensions of the C-beam 84.

If the C-beam 84 is substantially large, the beam 84 may be secured to the support member's head plate 78, by first forming holes (not shown) through a bottom portion 98 of the C-beam 84. The bolts 68 are then disposed through the apertures 86 in the head plate 78 and through the holes in the bottom portion 98 of the C-beam 84. The nuts 72 are threaded onto the bolts 68 to secure the C-beam 84 to the support member 52.

If the bottom portion 98 of the C-beam 84 is approximately half the length of the head plate 78, then the beam 84 may be secured to the support member 52 by first abutting the beam 84 with the head plate 78. A coupling plate 88 is then positioned over the beam's bottom portion 98. A nut 72 is tightened on the bolt 68, until the coupling plate 88 is slightly snug against the beam's bottom portion 98.

An L-bracket 100 is then affixed to the C-beam 84 for providing support of the C-beam 84 on the head plate 78. The L-bracket 100 is affixed to the C-beam 84 using the previously discussed methods. The L-bracket 100 has a bottom portion 102 dimensioned substantially equal to the width and length of one half of the head plate 78. The L-bracket 100 is affixed to the C-beam 84 such that the bottom portion 102 thereof extends substantially parallel to the bottom portion 98 of the C-beam 84. The L-bracket 100 has a pair of apertures (not shown) formed therethrough that are dimensioned and positioned complementary to the apertures 86 in the head plate 78.

A coupling plate 88 is then positioned over the L-bracket's bottom portion 102. The bolts 68 are disposed into the apertures 86 in the head plate 78 and through the apertures in the L-bracket 100. The nuts 72 are threaded onto the bolts 68 to tighten the coupling plates 88 against the bottom portions 98, 102 of the C-beam 84 and L-bracket 100, to couple the C-beam 84 to the support member 52.

The invented pier 30, 74 is firmly secured to the ground 13 and to the desired beam 82, 84. When the pad 34 is affixed to the ground 13, the pier 30, 74 becomes an integral component of an engineered foundation system. Such foundation systems help prevent supported mobile dwellings from inadvertently detaching from the foundation system due to seismic activity or wind, for example. The desired pier 30, 74 is secured to the beam 82, 84 at predetermined spatial intervals. The distance between the piers 30 (74) can depend upon several factors. Such factors may include, but are not limited to, dimensions of the dwelling to be supported, whether the piers 30 (74) are being installed in an existing foundation system or in new foundation system, and the building codes and requirements enforced at the installation location, for example.

Thus, there has been described an improved pier for use with movable dwellings. The plurality of webs prevent the support member and shaft from failing when increased force is applied thereto. The webs distribute horizontal and lateral forces applied to the support member, from environmental forces such as seismic activity or wind, to prevent the invented pier from failing. In the presence of increased environmental forces, force applied to the support member from a support I-beam or C-beam, is transmitted from the support member through the clamp means and distributed through the plurality of webs. Since there is substantially no inadvertent movement between the components of the invented pier when increased forces are applied thereto, the pier acts in a unitary fashion so that it does not collapse or become detached from either the ground or support beam, which could cause harm to the supported dwelling.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A foundation pier for supporting a movable dwelling comprising:

a base plate;

a threaded shaft affixed to said base plate and extending upwardly therefrom and perpendicular thereto;

a plurality of webs affixed to said base plate and extending upwardly therefrom, said webs spatially positioned about said shaft;

a support member threadably coupled to said shaft for adjusting the height of said pier, said support member having couple means at an end thereof for coupling said pier to a support beam of said dwelling; and clamp means comprising a clamp member having complementary first and second portions for receiving said support member therebetween, the first portion of said clamp member affixed to adjacent ones of said plurality of webs and the second portion of said clamp member affixed to adjacent ones of said plurality of webs such that the first and second portions of said clamp member are located adjacent to and oppose one another, said clamp means including a plurality of bolt member with complementary nuts, said bolt members adapted to be disposed through opposing holes in the first and second portions with said nuts tightened onto said bolts for coupling said clamp means to said support member to prevent movement therebetween.

2. The pier of claim 1 wherein said each of said plurality of webs have a first end affixed to said base plate and a second end, a first pair of said webs affixed to said base plate at a predetermined distance from said shaft and in substantial alignment with one another, a second pair of said plurality of webs spatially positioned about said shaft at a substantially ninety degree angle therebetween and each of said second pair of webs forming an angle of substantially forty five degrees with an adjacent one of said first pair of webs, the first end of each of said webs being substantially wider than the second end thereof so that force applied to said support member is transmitted through said clamp means and distributed by said webs.

3. The pier of claim 1 wherein said support member further comprises an elongated portion of cylindrical, hollow pipe, said pipe having an insert press-fit into an end thereof, said insert having a threaded aperture therethrough for threadably coupling said support member to said shaft, said pipe having a substantially flat, rectangular head plate affixed to the other end thereof, said head plate adapted to receive couple means for coupling said support member to a desired support beam of said dwelling.

4. The pier of claim 3 wherein said couple means is adapted to couple said support member to a support beam having an "I" configuration, said couple means including:

said head plate, said head plate having a plurality of elongated apertures formed therethrough and aligned with the longitudinal axis thereof, an aperture formed adjacent to each corner thereof, a pair of coupling plates for retaining the bottom portion of said "I" beam between said coupling plates and said head plate, each coupling plate having a width substantially equal to the width of said head plate and a length substantially one half the length of said head plate, each of said coupling plates having a pair of apertures formed therethrough adjacent to a side thereof, said apertures dimensioned complementary to the apertures in said head plate and aligned with the longitudinal axis of the coupling plate, such that a portion of said apertures are in alignment as said coupling plates are adjusted longitudinally along said head plate; and a plurality of bolt members with complementary nuts, said bolt members adapted to be disposed through said aligning apertures when the bottom portion of said "I" beam is interposed between said coupling plates and said head plate for coupling said beam to said support member, whereby the 'T' beam is abutted by said head plate, said coupling plates are then placed over the bottom portion of said "I" beam, then the bolt members are disposed through the apertures and the nuts are threaded onto the bolt members for tightening said coupling plates onto the bottom portion of said "I" beam for coupling said support member to said "I" beam to prevent movement therebetween.

5. The pier of claim 3 wherein said couple means is adapted to couple said support member to a support beam having a "C" configuration, said coupling means including:

said head plate, said head plate having a plurality of elongated apertures formed therethrough and aligned with the longitudinal axis thereof, an aperture formed adjacent to each corner thereof;

said "C" beam having a pair of elongated apertures formed complementary to the apertures in said head plate disposed through a bottom portion thereof; and a plurality of bolt members with complementary nuts, said bolt members adapted to be disposed into the apertures in the bottom portion of said "C" beam and through the apertures in said head plate, said nuts being threaded onto said bolt members to tighten said "C" beam to said support member to prevent movement therebetween.

6. The pier of claim 5 further comprising an "L" bracket affixed to said "C" beam for providing support of said "C" beam on said head plate, said "L" bracket having a side with a width substantially equal to the width of said head plate and extending parallel to the bottom portion of said "C" beam, said "L" bracket having a pair of apertures formed therethrough adjacent to an edge thereof, said apertures dimensioned complementary to the apertures in said head plate and in alignment therewith, so that said bolt members may be disposed through the apertures in the bracket and into the apertures in said head plate for coupling said "C" beam to said support member to prevent movement therebetween.

7. The pier of claim 1 further comprising a foundation pad for supporting said base plate above a ground surface, said pad including means of coupling said base plate to said pad.

8. The pier of claim 1 wherein said pier comprises steel alloy.

9. A foundation pier for supporting a movable dwelling, such as a mobile home, said pier comprising:

a rectangular base plate;

a threaded shaft affixed to said base plate a centermost position thereof, said shaft extending upwardly from said base plate and perpendicular thereto;

a plurality of webs having a first end affixed to said base plate and a second end, said webs spatially positioned about said shaft at predetermined intervals, the first end of each of said webs being substantially wider than the second end thereof;

an elongated cylindrical support member having a first end and a second end, the first end of said support member threadably coupled to said shaft for threading said support member longitudinally along said shaft for adjusting the height of said pier, the second end of said support member having a flat rectangular head plate affixed thereto, said head plate including couple means detachably coupled thereto for attaching said pier to a support beam of said movable dwelling; and clamp means comprising first and second portions for receiving said support member therebetween, the first portion of said clamp means affixed to a first pair of said plurality of webs adjacent to the second end of each web, the second portion of said clamp means affixed to a second pair of said plurality of webs adjacent to the second end of each web and opposite to said first pair of webs, such that the first and second portions of said clamp means are located adjacent to and oppose one another, said clamp means including means for reducing the distance between the first and second portions thereof to couple said clamp means to the support member for preventing movement of said support member relative to said shaft and said clamp means, whereby force applied to said support member is transmitted from said clamp means and distributed through said plurality of webs for preventing said pier from collapsing.

10. The pier of claim 9 wherein said pier comprises hardened steel alloy.

11. The pier of claim 9 further comprising a foundation pad for supporting said base plate on a ground surface, said pad including means of coupling said base plate to said pad.

* * * * *